United States Patent [19]

Cha

[11] 4,156,461

[45] May 29, 1979

[54] DECREASING HYDROCARBON, HYDROGEN AND CARBON MONOXIDE CONCENTRATION OF A GAS

[75] Inventor: Chang Y. Cha, Bakersfield, Calif.

[73] Assignee: Occidental Oil Shale, Inc., Grand Junction, Colo.

[21] Appl. No.: 861,237

[22] Filed: Dec. 16, 1977

[51] Int. Cl.[2] ..... E21B 43/24

[52] U.S. Cl. ..... 166/256; 166/259; 166/300; 423/246; 423/248; 299/2

[58] Field of Search ..... 299/2–5, 299/7; 166/259, 256, 260, 270, 265–267, 300; 423/245, 246, 248

[56] References Cited

U.S. PATENT DOCUMENTS

| | | | |
|---|---|---|---|
| Re. 29,553 | 2/1978 | Burton et al. | 166/256 X |
| 3,454,958 | 7/1969 | Parker | 166/256 |
| 3,661,423 | 5/1972 | Garrett | 299/13 X |
| 3,994,343 | 11/1976 | Cha et al. | 166/259 |
| 4,014,575 | 3/1977 | French et al. | 299/2 |

*Primary Examiner*—Stephen J. Novosad
*Attorney, Agent, or Firm*—Arnold Grant

[57] ABSTRACT

The concentration of hydrocarbons, hydrogen, and carbon monoxide in a gas is reduced by combining these constituents in the gas with oxygen in the presence of a fragmented permeable mass of particles containing oil shale treated to remove organic materials.

16 Claims, 1 Drawing Figure

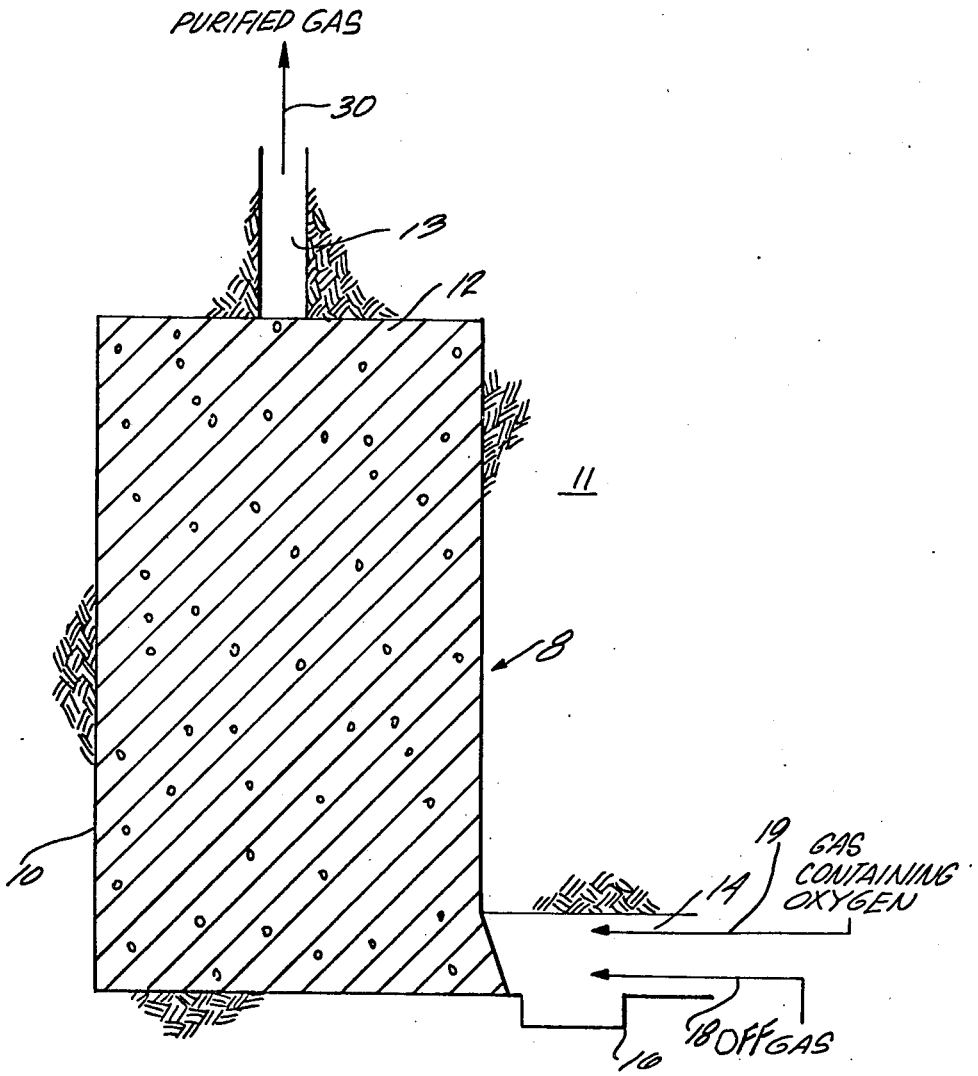
PURIFIED GAS
30
13
12
11
8
10
19
GAS
CONTAINING
OXYGEN
14
18
OFF GAS
16

DECREASING HYDROCARBON, HYDROGEN AND CARBON MONOXIDE CONCENTRATION OF A GAS

CROSS-REFERENCE

This application is related to U.S. Pat. application Ser. No. 780,927, filed on Mar. 24, 1977, entitled Oxidizing Hydrogen Sulfide, and filed by Leslie E. Compton now U.S. Pat. No. 4,086,963; U.S. Pat. application Ser. No. 780,928, filed on Mar. 24, 1977, entitled Low Temperature Oxidation of Hydrogen Sulfide in the Presence of Oil Shale, and filed by Leslie E. Compton and William H. Rowan, now U.S. Pat. No. 4,082,146; U.S. Pat. applicaton Ser. No. 780,926, filed on Mar. 24, 1977 entitled Removing Hydrogen Sulfide From A Gas, and filed by Leslie E. Compton, now U.S. Pat. No. 4,121,663; U.S. Pat. application Ser. No. 780,924, filed on Mar. 24, 1977, by Chang Yul Cha entitled Decreasing Hydrogen Sulfide Concentration Of A Gas, now U.S. Pat. No. 4,086,962; and, U.S. Pat. application Ser. No. 861,238, filed on Dec. 16, 1977 entitled Oxidizing Hydrocarbons, Hydrogen And Carbon Monoxide filed by Leslie E. Compton. Each of these patent applications is incorporated herein by reference.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit interspersed with layers containing an organic polymer called "kerogen", which upon heating decomposes to product liquid and gaseous products. It is the formation containing kerogen that is called "oil shale" herein, and the liquid product is called "shale oil". A number of methods have been developed for processing the oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972, to Donald E. Garrett, assigned to the assignee of this application and incorporated herein by reference. This patent describes in situ recovery of liquid and gaseous carbonaceous materials from a subterranean formation containing oil shale by fragmenting such formation to form a stationary, fragmented, permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing "retorted oil shale".

One method of supplying hot retorting gases used for converting kerogen contained in the oil shale, as described in U.S. Pat. No. 3,661,423, includes establishment of a combustion zone in the retort and movement of an oxygen supplying gaseous feed mixture into the combustion zone as a gaseous combustion zone feed to advance the combustion zone through the retort. In the combustion zone oxygen in the gaseous feed mixture is depleted by reaction with hot carbonaceous materials to produce heat and a combustion gas. By the continued introduction of the oxygen supplying gaseous feed mixture into the combustion zone, the combustion zone is advanced through the retort.

The combustion gas and the portion of the gaseous feed mixture which does not take part in the combustion process pass through the retort on the advancing side of the combustion zone to heat the oil shale in the retorting zone to a temperature sufficient to produce kerogen decomposition, called retorting, in the oil shale to gaseous and liquid products and a residue of solid carbonaceous material.

The liquid products and gaseous products are cooled by the cooler oil shale fragments in the retort on the advancing side of the retorting zone. The liquid carbonaceous products, together with water produced in or added to the retort, are withdrawn from the retort on the advancing side of the retorting zone. An off gas containing combustion gas generated in the combustion zone, gaseous products of the retorting zone, gas from carbonate decomposition, and the portions of gaseous feed mixture which does not take part in the combustion process is also withdrawn from the retort on the advancing side of the retorting zone.

The off gas, which contains nitrogen, hydrogen, carbon monoxide, carbon dioxide, methane, ethane, ethylene, propane, propylene and other hydrocarbons, water vapor, and hydrogen sulfide must be disposed of in an ecologically sound manner. This is primarily because its low fuel value, i.e., less than about 70 BTU per standard cubic foot, can make it uneconomical to use as a fuel. Added to this is the difficulty encountered in initiating and maintaining combustion of fuels with such a low BTU content. Since environmental considerations prohibit discharge of such gas directly to the atmosphere, there is a need for an exonomical method of purifying the off gas from an in situ oil shale retort.

The present invention is addressed to this problem and, as will be described in greater detail hereafter, is able to accomplish such purification while taking advantage of the heretofore wasted sensible heat remaining in an in situ oil shale retort at the conclusion of the retorting operation.

SUMMARY OF THE INVENTION

According to a method of this invention, the hydrocarbon, hydrogen and carbon monoxide concentration of a gas are reduced by reacting these constituents of the gas with an oxygen bearing material in the presence of a fragmented permeable mass of particles containing oil shale. The oil shale promotes the oxidation of the hydrocarbons, hydrogen and carbon monoxide to water and carbon dioxide. Preferably the oil shale has been treated to remove organic materials and retains a portion of the sensible heat generated during such treatment. Such gas with relatively lower hydrocarbon, hydrogen and carbon monoxide concentration is then withdrawn from the fragmented permeable mass of oil shale.

An additional feature of the instant invention is that at least a portion of the carbon dioxide generated by the reaction of the hydrocarbon and carbon monoxide constituents of the gas can be reduced by reacting it with alkaline earth metal oxides contained in the treated oil shale.

DRAWING

These and other features, aspects and advantages of the present invention will become more apparent with respect to the following description, appended claims and accompanying drawing which is a schematic representation in vertical cross section of an in situ oil shale retort containing oil shale being used for decreasing the hydrocarbon, hydrogen, and carbon monoxide concentration of a gas stream.

DESCRIPTION

Referring to the drawing, an already retorted in situ oil shale retort 8 is shown in the form of a cavity 10 formed in an unfragmented subterranean formation 11 containing oil shale. The cavity contains an explosively expanded and fragmented permeable mass 12 of formation particles. The cavity 10 can be created simultaneously with fragmentation of the mass of formation particles 12 by blasting using any of a variety of techniques. Methods of forming an in situ oil retort are described in U.S. Pat. Nos. 3,661,423, 4,043,595, 4,043,596, 4,043,597, and 4,043,598. A variety of other techniques can also be used.

A conduit 13 communicates with the top of the fragmented mass of formation particles. During the retorting operation of the retort 8, a combustion zone is established in the retort and advanced by introducing a gaseous feed containing an oxygen supplying gas, such as air or air mixed with other gases, into the in situ oil shale retort through the conduit 13. As the gaseous feed is introduced to the combustion zone, oxygen oxidizes carbonaceous material in the oil shale to produce combusted oil shale and combustion gas. Heat from the exothermic oxidation reactions, carried by flowing gases, advances the combustion zone downwardly through the fragmented mass of particles.

Combustion gas produced in the combustion zone, any unreacted portion of the oxygen supplying gaseous feed and gas from carbonate decomposition are passed through the fragmented mass of particles on the advancing side of the combustion zone to establish a retorting zone on the advancing side of the combustion zone. Kerogen in the oil shale is retorted in the retorting zone to yield retorted oil shale and liquid and gaseous products, including hydrocarbons.

There is a drift 14 in communication with the bottom of the retort. The drift contains a sump 16 in which liquid products are collected to be withdrawn for further processing. An off gas containing gaseous products, combustion gas, gas from carbonate decomposition, and any unreacted portion of the gaseous combustion zone feed is also withdrawn from the in situ oil shale retort 8 by way of the drift 14. The off gas can contain large amounts of nitrogen with lesser amounts of hydrogen, carbon monoxide, hydrocarbons such as methane, ethane, ethylene, propane, propylene and higher hydrocarbons, water vapor and sulfur compounds such as hydrogen sulfide. The off gas also can contain particulates and hydrocarbon-containing aerosols. Because of its low BTU value, the off gas cannot be used as a fuel without costly addition of supplemental fuel or expensive compression or preheating to sustain a flame. Moreover, in view of environmental considerations, it is undesirable to directly discharge it to the atmosphere. There thus exists the problem of economically purifying the off gas.

At the end of retorting operations at least part of the oil shale in the retort 8 is at an elevated temperature which should be at least about 600° F. and can be in excess of about 1000° F. During retorting operations the maximum temperature in the combustion zone can be in the order of about 1150° F. to about 1800° F. The hottest region of the retort is often near the bottom, and a somewhat cooler region is near the top due to the continual cooling caused by introduction of the gaseous feed containing oxygen during retorting and conduction of heat to adjacent shale.

The retort illustrated in the drawing has had retorting and combustion operations completed and contains a fragmented permeable mass of hot formation particles containing combusted oil shale. Such a retort can be referred to as "spent". As used herein, the term "raw oil shale" means oil shale which has not been subjected to any processing affecting the chemical composition of the oil shale. The term "retorted oil shale" refers to oil shale heated to sufficient temperature to decompose kerogen in an environment substantially free of free oxygen so as to leave a solid carbonaceous residue. The term "combusted oil shale" refers to oil shale of reduced carbon content due to oxidation by a gas containing free oxygen. The term "treated oil shale" refers to oil shale treated to remove organic materials and includes retorted and/or combusted oil shale. An individual particle containing oil shale can have a core of retorted oil shale and an outer "shell" of combusted oil shale. Such can occur when oxygen has diffused only part way through the particle during the time it is at an elevated temperature and in contact with an oxygen supplying gas.

A process gas stream 18 containing off gas from an active oil shale retort, and a gas stream 19 containing oxygen, such as air, are introduced through the drift 14 to the already treated retort 8. By "active retort" is meant a retort in which combustion and retorting operations are being conducted. It will be understood that although the "oxygen containing gas" is ordinarily ambient air, other composition variations are included within the term. Thus, for example, if desired, pure oxygen or air augmented with additional oxygen can be used so that the partial pressure of oxygen is increased. Similarly, air can be diluted with an oxygen free gas such as nitrogen. The off gas and oxygen containing gas can be introduced separately into the retort, or can be substantially homogeneously mixed prior to introduction into the retort. Mixing can be accomplished by any of a number of methods, such as, with jet mixers, injectors, fans and the like. Preferably the off gas and the oxygen containing gas are introduced to the hottest portion of the fragmented permeable mass in the retort to minimize pressure drop through the retort and the cost of passing gas through the retort. By introducing the gases to the hottest portion of the retort, heat is transferred by the flowing gases to the cooler portions of the retort, with the result that the fragmented permeable mass eventually has a substantially uniform temperature gradient, and no exceptionally hot region, with the temperature decreasing in the direction of movement of the gases. This results in reduced pressure drop across the retort because the volumetric flow rate of the gases through the retort decreases as the temperature of the fragmented permeable mass increases due to thermal contraction of the formation particles as the mass of particles cools. Thus, the cross sectional area available for flow of gases through the retort increases.

Therefore, as shown in the drawing, when a fragmented permeable mass in an in situ oil shale retort is retorted from top to bottom, preferably the off gas and the oxygen containing gas are introduced to the bottom of the retort, and purified effluent gas is withdrawn from the top of the retort. An advantage of introducing the gas to the bottom of the retort, as shown in the drawing, is that off gas from the bottom of an adjacent active retort can be directly introduced to the bottom of the spent retort 8 without having to incur the capital and operating expenses of transferring the off gas to the surface.

For economy, the conduit used for introducing oxygen supplying gaseous feed to the retort 8 during the retorting operation is utilized to withdraw an effluent gas 30 of reduced hydrocarbon, hydrogen, carbon monoxide and hydrogen sulfide concentration from the retort. Similarly, the drift 14 used for withdrawing off gas from the retort 8 during the retorting operation is utilized for introducing the gas streams 18, 19 to the retort. The effluent gas 30 has a relatively lower hydrocarbon, hydrogen, carbon monoxide, hydrogen sulfide and total sulfur concentration than the gas 18 introduced into the retort 8.

As the off gas stream 18 and the oxygen containing gas stream 19 pass through the hot spent retort, hydrocarbons are oxidized to carbon dioxide and water, hydrogen is oxidized to water, carbon monoxide is oxidized to carbon dioxide, and hydrogen sulfide is oxidized to sulfur and oxygen bearing compounds, including sulfur dioxide. Although not essential, it is preferred that there be a stoichiometric excess of oxygen. Surprisingly, it was found that these oxidations readily occur, notwithstnding the relatively low fuel value and the previous difficulties encountered with combusting off gas.

It has been found, however, that at temperatures below about 600° F., the rate of conversion of the hydrocarbons, hydrogen and carbon monoxide to carbon dioxide and water can be too slow and/or the flow rate of off gas can be too great to achieve adequate removal in a single retort. The off gas 18 can then be passed with an oxygen containing gas through additional retorts, in series and/or parallel, containing oil shale treated to remove organic materials, or recirculated several times in a single retort to achieve maximum removal.

Oil shale contains large quantities of alkaline earth metal carbonates, principally calcium and magnesium carbonates, which during retorting and combustion are at least partly calcined to produce alkaline earth metal oxides. Thus combusted oil shale particles in the retort 8 can contain approximately 20 to 30% calcium oxide and 5 to 10% magnesium oxide, with smaller quantities of less reactive oxides present.

The carbon dioxide and sulfur dioxide produced from the reactions can combine with these constituents of the oil shale to yield solid materials such as carbonates and sulfites. For example, as the reaction gases pass through the retort, carbon dioxide in the gas can combine in the presence of water with the oxides of calcium and magnesium to form the corresponding carbonates. Similarly, the oxides of sulfur present in the gas can combine in the presence of water with the oxides of calcium and magnesium to form calcium and magnesium sulfites. Exemplary of the reactions which can occur are the following:

$$MO + CO_2 \rightarrow MCO_3$$

$$MO + SO_2 \rightarrow MSO_3$$

where M represents an alkaline earth metal. Water present in the retort is expected to enhance the rates of reaction of carbon dioxide and sulfur dioxide with alkaline earth metal oxides. Although not essential it is preferred that the fragmented permeable mass of hot oil shale has a stoichiometric excess of alkaline earth metal oxides relative to the carbon dioxide and sulfur dioxide formed by combining the hydrocarbon, hydrogen, carbon monoxide and hydrogen sulfide constituents of the off gas with oxygen. Thus a substantial portion of the carbon dioxide resulting from the oxidation of the hydrocarbons and carbon monoxide and the sulfur dioxide resulting from oxidation of hydrogen sulfide can be removed from the gas passing through the retort, especially with high temperatures in the mass of particles in the retort and at high molar ratios of alkaline earth metal oxides to carbon dioxide and sulfur dioxide. Therefore, when an oil shale retort containing treated oil shale is used, not only can the hydrocarbon, hydrogen, carbon monoxide and hydrogen sulfide content of a gas stream be reduced, but also the total concentration of sulfur compounds in the gas stream can be reduced.

The direct reactions between carbon dioxide and sulfur dioxide and calcium or magnesium oxide to form carbonates and sulfites occur slowly at ambient temperature; however, at temperatures of about 600° F. to about 1800° F., which can exist in the upstream portion of the spent retort, short reaction times occur. From a practical standpoint, the maximum temperature for these reactions in the presence of oil shale is the fusion temperature of oil shale, which is about 2200° F. Generally, sufficient alkaline earth metal oxides are present in a retort to remove substantial portions of the carbon dioxide and sulfur dioxide formed from oxidation of the hydrocarbons, hydrogen, carbon monoxide and hydrogen sulfide in off gas generated from retorting oil shale in a retort of comparable size. For example, retorting one ton of oil shale particles can yield 750 pounds of alkaline earth metal oxides.

Although the drawing shows the off gas and oxygen containing gas reacting in the presence of oil shale which was treated to remove organic materials by combustion, it has been found that hydrocarbons, hydrogen, carbon monoxide and hydrogen sulfide can be removed from gas streams by oxidation in the presence of raw oil shale. Thus, this invention contemplates combining off gas with oxygen in the presence of either raw, or treated, i.e., retorted and/or combusted, oil shale.

The method of this invention has many advantages over prior art processes. By using oil shale to remove hydrocarbons, hydrogen, carbon monoxide and hydrogen sulfide from gas streams such as off gas from an in situ oil shale retort, the purchase of absorbents or adsorbents for these materials is avoided. Furthermore, when oil shale contained in an in situ oil shale is used, the oil shale remains in the ground, thereby eliminating disposal problems. In addition, a large stoichiometric excess of treated oil shale is available. Thus regeneration of oil shale, even if its activity is greatly reduced by poisoning, is unnecessary. A long residence time of the off gas and gaseous source of oxygen can be utilized to achieve high conversion. Another advantage of the method of this invention is that while utilizing the sensible heat of retorted oil shale, which otherwise might not be used, heating of the off gas prior to removing the hydrocarbons, hydrogen, carbon monoxide and hydrogen sulfide can be avoided.

The following examples demonstrate the efficacy of treated oil shale in promoting the oxidation of hydrocarbons, hydrogen, carbon monoxide and hydrogen sulfide to reduce the concentration of these constitutents in a gas.

EXAMPLES

A mixture of carbon monoxide, hydrogen, methane, ethane, ethylene, propylene and traces of $C_4$ and $C_5$ hydrocarbons approximating the percentages found in the off gas produced from in situ retorting of oil shale was channeled through a 7 inch high reactor with a 1 inch diameter bed of combusted oil shale having a particle size in the range of from about −3 to about +8 mesh at a superficial flow rate of 6 SCFM per square foot of oil shale bed. A first run was made with the oil shale bed heated to 700° F. and a second run was made with the bed at 850° F. In both instances the residence time of the mixture in the oil shale bed was about 3 seconds. The following table shows the results of these experiments.

TABLE I

| | Temp. °F. | $C_4$ | $C_5$+ | $C_2H_4$ | $C_2H_6$ | $CH_4$ | $C_3H_6$ | CO | $H_2$ |
|---|---|---|---|---|---|---|---|---|---|
| | | Vol. % | | | | | | | |
| Inlet | 700 | 0.002 | 0.020 | 0.028 | 0.78 | 2.15 | 0.006 | 2.95 | 4.33 |
| Outlet | | 0.002 | 0.020 | 0.026 | 0.003 | 0.044 | 0.006 | 1.05 | 0.044 |
| Inlet | 850 | 0.003 | 0.023 | 0.042 | 0.789 | 2.17 | 0.012 | 2.994 | 4.44 |
| Outlet | | 0.002 | 0.019 | 0.029 | 0.004 | 0.000 | 0.003 | 0.233 | 0.057 |

Although this invention has been described in considerable detail with reference to certain versions thereof, other versions of the invention are within the scope of this invention. Thus the spirit and scope of the appended claims should not necessarily be limited to the description of the preferred embodiments.

What is claimed is:

1. A method for recovering gaseous products from a first in situ oil shale retort in a subterranean formation containing oil shale, said first in situ retort containing an explosively expanded and fragmented permeable mass of particles containing oil shale and having a combustion zone and a retorting zone advancing therethrough, the method comprising the steps of:

(a) introducing into the first in situ oil shale retort on the trailing side of the combustion zone a combustion zone feed comprising oxygen to advance the combustion zone through the fragmented mass of particles and proudce combustion gas in the combustion zone;

(b) passing said combustion gas and any unreacted portion of the combustion zone feed through a retorting zone in the fragmented mass of particles on the advancing side of the combustion zone, wherein oil shale is retorted and gaseous products including hydrocarbons are produced;

(c) withdrawing a retort off gas comprising said gaseous products including hydrocarbons, hydrogen, carbon monoxide and any gaseous unreacted portions of the combustion zone feed from the first in situ oil shale retort on the advancing side of the retorting zone; and (d) reducing the hydrocarbon, hydrogen and carbon monoxide concentration of the retort off gas withdrawn from the first retort by the steps of:

(i) introducing at least a portion of the retort off gas from the first retort into a second retort containing an explosively expanded and fragmented permeable mass of formation particles containing oil shale;

(ii) concurrently introducing oxygen containing gas into the second retort for reacting oxygen in the oxygen containing gas with the hydrocarbons, hydrogen and carbon monoxide in the introduced off gas in the presence of oil shale in the second retort to form carbon dioxide and water, whereby gas having a hydrocarbon, hydrogen and carbon monoxide concentration relatively lower than the concentration of these constituents in the introduced retort off gas is produced, and withdrawing gas with relatively lower hydrocarbon, hydrogen and carbon monoxide concentration from the second retort.

2. A method of decreasing the hydrocarbon, hydrogen and carbon monoxide concentration of a gas comprising the steps of:

introducing a gas containing relatively higher hydrocarbon, hydrogen and carbon monoxide concentration to a fragmented permeable mass of oil shale said oil shale being at a temperature of less than about 600° F.;

reacting hydrocarbons, hydrogen and carbon monoxide in the gas with oxygen in the presence of the oil shale to yield gas having a hydrocarbon, hydrogen and carbon monoxide concentration relatively lower than the hydrocarbon, hydrogen and carbon monoxide concentration of the introduced gas; and withdrawing gas with relatively lower hydrocarbon, hydrogen and carbon monoxide concentration from the fragmented permeable mass of oil shale.

3. A method of decreasing the hydrocarbon, hydrogen and carbon monoxide concentration of a gas as defined in claim 2 further comprising the steps of introducing the gas with relatively lower hydrocarbon, hydrogen and carbon monoxide concentration to a second permeable mass of oil shale; reacting hydrocarbons, hydrogen and carbon monoxide in the gas with oxygen in the presence of the second permeable mass of oil shale to further reduce the hydrocarbon, hydrogen and carbon monoxide concentration of the gas; and, withdrawing said gas from the second permeable mass of oil shale.

4. A method of decreasing the hydrocarbon, hydrogen and carbon monoxide concentration of a gas as defined in claim 2 further comprising the steps of reintroducing the gas with relatively lower hydrocarbons, hydrogen and carbon monoxide to the fragmented permeable mass of oil shale to further react the hydrocarbons, hydrogen and carbon monoxide in the gas with oxygen in the presence of the oil shale to further reduce the hydrocarbon, hydrogen and carbon monoxide concentration of the gas; and, withdrawing said gas from the fragmented permeable mass of oil shale.

5. A method for decreasing hydrocarbon, hydrogen and carbon monoxide concentration of a gas stream from an in situ oil shale retort, comprising the steps of:

forming carbon dioxide and water by combining the gas with oxygen in the presence of a fragmented permeable mass of particles containing oil shale, wherein at least a portion of the oil shale contains alkaline earth metal oxides for combining with the formed carbon dioxide.

6. The method of claim 5 wherein the fragmented permeable mass has a stoichiometric excess of alkaline earth metal oxides relative to the carbon dioxide formed by combining hydrocarbons, hydrogen and carbon monoxide constituents of the off gas with oxygen.

7. A method for removing hydrocarbons, hydrogen and carbon monoxide from a gas stream comprising the steps of:

forming a first in situ oil shale retort in a subterranean formation containing oil shale, said first in situ retort containing a fragmented permeable mass of formation particles containing oil shale and alkaline earth metal carbonates;

introducing a gaseous combustion zone feed comprising an oxygen supplying gas into a combustion zone in the fragmented mass for advancing the combustion zone through the fragmented mass of particles and producing combustion gas and converting at least a portion of the alkaline earth metal carbonates to corresponding alkaline earth metal oxides;

ending advancement of the combustion zone;

thereafter, contacting, in the presence of oxygen, formation particles at a temperature greater than about 600° F. in the first in situ retort with a process gas with relatively higher hydrocarbon, hydrogen and carbon monoxide concentration to form carbon dioxide and water, wherein at least a portion of the formed carbon dioxide combines with alkaline earth metal oxides contained in the first retort to yield gas having a hydrocarbon, hydrogen and carbon monoxide concentration relatively lower than the hydrocarbon, hydrogen and carbon monoxide concentration of the process gas; and withdrawing gas with relatively lower hydrocarbon, hydrogen and carbon monoxide concentration from the first in situ oil shale retort.

8. The method of claim 7 in which the gas containing relatively higher hydrocarbon, hydrogen and carbon monixide concentration comprises off gas from a second in situ oil shale retort.

9. A method for decreasing hydrocarbon, hydrogen and carbon monoxide concentration of a gas stream comprising the steps of passing a gas containing relatively higher hydrocarbon, hydrogen and carbon monoxide concentration through an in situ oil shale retort containing an explosively fragmented permeable mass of oil shale particles and including alkaline earth metal oxides, while concurrently introducing a source of oxygen into said retort to combine therein with said hydrocarbons, hydrogen and carbon monoxide and alkaline earth metal oxides to form alkaline earth metal carbonates, whereby the gas after passing through the first retort is of relatively lower hydrocarbon, hydrogen and carbon monoxide concentration than the gas before passing through the first retort.

10. The method of claim 9 in which the gas of relatively higher hydrocarbon, hydrogen and carbon monoxide concentration comprises off gas from a second oil shale retort.

11. A method of decreasing hydrocarbon, hydrogen and carbon monoxide concentration of a gas comprising the steps of:

introducing a gas with a first hydrocarbon, hydrogen and carbon monoxide concentration to a fragmented permeable mass of oil shale, including alkaline earth metal oxides while concurrently introducing a source of oxygen;

reacting at least a portion of the hydrocarbons, hydrogen and carbon monoxide in the gas with oxygen in the presence of the said oil shale and at least a portion of the products thereof with the alkaline earth metal oxides to yield gas having a lower hydrocarbon, hydrogen and carbon monoxide concentration and alkaline earth metal carbonates; and withdrawing gas with lower hydrocarbon, hydrogen and carbon monoxide concentration from the fragmented permeable mass of oil shale.

12. A method for reducing the hydrocarbon, hydrogen and carbon monoxide concentration of an off gas from an in situ oil shale retort, the off gas containing hydrocarbons, hydrogen and carbon monoxide and water, comprising the steps of:

introducing the off gas to a fragmented permeable mass of oil shale including alkaline earth metal oxides;

reacting at least a portion of the hydrocarbons, hydrogen and carbon monoxide in the off gas with oxygen in the presence of said oil shale to produce gas having a hydrocarbon, hydrogen and carbon monoxide concentration relatively lower than the hydrocarbon, hydrogen and carbon monoxide concentration of the off gas and reacting at least a portion of the products thereof with at least a portion of the alkaline earth metal oxides to form alkaline earth metal carbonates; and withdrawing such gas having relatively lower hydrocarbon, hydrogen and carbon monoxide concentration from the fragmented permeable mass of oil shale.

13. A method for reducing the hydrocarbon, hydrogen and carbon monoxide concentration of an off gas from an in situ oil shale retort, comprising the steps of:

introducing the off gas to a fragmented permeable mass of oil shale including alkaline earth metal oxides;

reacting at least a portion of the hydrocarbons, hydrogen and carbon monoxide in the off gas with oxygen in the presence of the oil shale to yield gas having a hydrocarbon, hydrogen and carbon monoxide concentration relatively lower than the concentrations in the introduced off gas and reacting at least a portion of the products thereof with at least a portion of the alkaline earth metal oxides; and withdrawing gas having relatively lower hydrocarbon, hydrogen and carbon monoxide concentration from the fragmented permeable mass of oil shale.

14. A method of decreasing the hydrocarbon, hydrogen and carbon monoxide concentration of a gas comprising the steps of:

introducing a gas containing relatively higher hydrocarbon, hydrogen and carbon monoxide concentration to a fragmented permeable mass of raw oil shale;

reacting hydrocarbons, hydrogen and carbon monoxide in the gas with oxygen in the presence of the oil shale to yield gas having a hydrocarbon, hydrogen and carbon monoxide concentration relatively lower than the hydrocarbon, hydrogen and carbon monoxide concentration of the introduced gas; and withdrawing gas with relatively lower hydrocarbon, hydrogen and carbon monoxide concentration from the fragmented permeable mass of oil shale.

15. A method of decreasing the hydrocarbon, hydrogen and carbon monoxide concentration of a gas as defined in claim 14 further comprising the steps of introducing the gas with relatively lower hydrocarbon, hydrogen and carbon monoxide concentration to a second permeable mass of oil shale; reacting hydrocarbons, hydrogen and carbon monoxide in the gas with oxygen in the presence of the second permeable mass of oil shale to further reduce the hydrocarbon, hydrogen and carbon monoxide concentration of the gas; and, withdrawing said gas from the second permeable mass of oil shale.

16. A method of decreasing the hydrocarbon, hydrogen and carbon monoxide concentration of a gas as defined in claim 14 further comprising the steps of reintroducing the gas with relatively lower hydrocarbons, hydrogen and carbon monoxide to the fragmented permeable mass of oil shale to further react the hydrocarbons, hydrogen and carbon monoxide in the gas with oxygen in the presence of the oil shale to further reduce the hydrocarbon, hydrogen and carbon monoxide concentration of the gas; and, withdrawing said gas from the fragmented permeable mass of oil shale.

* * * * *